US005454435A

United States Patent [19]

Reinhardt

[11] Patent Number: 5,454,435

[45] Date of Patent: Oct. 3, 1995

[54] DEVICE FOR FACILITATING INSERTION OF A BEACH UMBRELLA IN SAND

[76] Inventor: Lisa Reinhardt, 7501 Monroe Rd., Charlotte, N.C. 28212

[21] Appl. No.: 249,148

[22] Filed: May 25, 1994

[51] Int. Cl.[6] ..... E21B 10/44

[52] U.S. Cl. ..... 175/19; 175/388; 175/394

[58] Field of Search ..... 175/19–21, 388, 175/394

[56] References Cited

U.S. PATENT DOCUMENTS

| | | | |
|---|---|---|---|
| 6,880 | 11/1849 | Crafts et al. | 175/394 |
| 136,555 | 3/1873 | Smith | 175/394 |
| 228,044 | 5/1880 | Dine | 175/388 |
| 365,247 | 6/1887 | Elliott | 175/388 |
| 379,345 | 3/1888 | Tow | 175/394 |
| 1,106,097 | 8/1914 | Iwan . | |
| 1,142,646 | 6/1915 | Watkins et al. . | |
| 1,177,406 | 3/1916 | Finley . | |
| 4,122,905 | 10/1978 | Kanigan . | |
| 4,456,075 | 6/1984 | Hostetter . | |

*Primary Examiner*—Michael Powell Buiz
*Attorney, Agent, or Firm*—Shefte, Pinckney & Sawyer

[57] ABSTRACT

A device for facilitating the insertion of a beach umbrella in the sand includes a shaft formed as a helix about an axis of rotation with a handle attached to one end thereof. The curvature of the helix defines a major diameter and the shaft of the device is at least a quarter the size of the major diameter. The shaft is manually inserted in the sand and then withdrawn thereby forming a hole for the insertion of the beach umbrella support shaft.

11 Claims, 4 Drawing Sheets

DEVICE FOR FACILITATING INSERTION OF A BEACH UMBRELLA IN SAND

BACKGROUND OF THE INVENTION

The present invention relates generally to implements of a recreational nature and, more particularly, to a device for facilitating the upright placement of a beach umbrella in sand, particularly beach sand.

When visiting the shore, most people seek some shelter from the sun. Beach umbrellas are commonplace sun shelters which are convenient to transport. Further, some organized beaches rent umbrellas to visitors. Most beach umbrellas consist of a retractable canopy mounted to a support shaft which terminates in an end portion for insertion in the sand. To properly erect the umbrella, the shaft must be driven into the sand to a predetermined depth so that the sand will hold the umbrella upright and prevent it from easily overturning, even in a stiff sea breeze.

The task is not as easy as it could be. When driving the umbrella into sand, the smooth, straight umbrella shaft will compact the sand downwardly which increases the required insertion force with depth. Generally, no grips are provided on the umbrella shaft and the user's hands can slip along the shaft during insertion. Twisting the umbrella from side to side does little to alleviate the problem. It would be desirable to have a preformed hole in the sand in which the umbrella could be inserted. Shovels or spades are of little use in this regard because such a hole needs to substantially conform to the shape of the beach umbrella shaft to provide proper lateral support for an upright beach umbrella.

SUMMARY OF THE INVENTION

It is accordingly an object of the present invention to provide an apparatus to form a hole in the sand into which the shaft of a beach umbrella may be inserted to the proper depth while maintaining a sufficient sand wall to support the beach umbrella once it is in its upright disposition.

It is further an object of the present invention to provide a device for forming such a hole, the device being easily transportable, light in weight, and easy to manufacture. To that end, and according to the preferred embodiment of the present invention, a device for facilitating the upright placement of a beach umbrella in sand includes a generally longitudinally extending shaft having a first end portion and a second end portion, the shaft being formed as a helix about an axis of rotation. The helix defines a major diameter bounded by the outermost extent of the helical curvature, with the first and second end portions being formed with a diameter that is a predetermined amount smaller than the value of the major diameter. Preferably, the helical shaft is formed with a diameter that is at least a quarter the size of the major diameter and the major diameter generally conforms to the diameter of the beach umbrella support shaft.

The first end portion is configured for insertion in the sand and a handle is provided and disposed at the second end portion. The handle is included for manually causing rotation of the helical shaft for driving the shaft into the sand and for the manual withdrawal of the shaft, thereby forming a hole in the sand for insertion of the beach umbrella support shaft in the sand.

The handle may be formed as a rod formed integrally with the second end portion in a generally perpendicular relationship therewith, with a portion of the rod extending outwardly away from the helical shaft. It is preferred that the handle include a hand grip.

For ease of manufacture, the device of the present invention is preferably formed in a mold from a thermoplastic material.

DESCRIPTION OF THE PREFERRED EMBODIMENT

Figure 1:
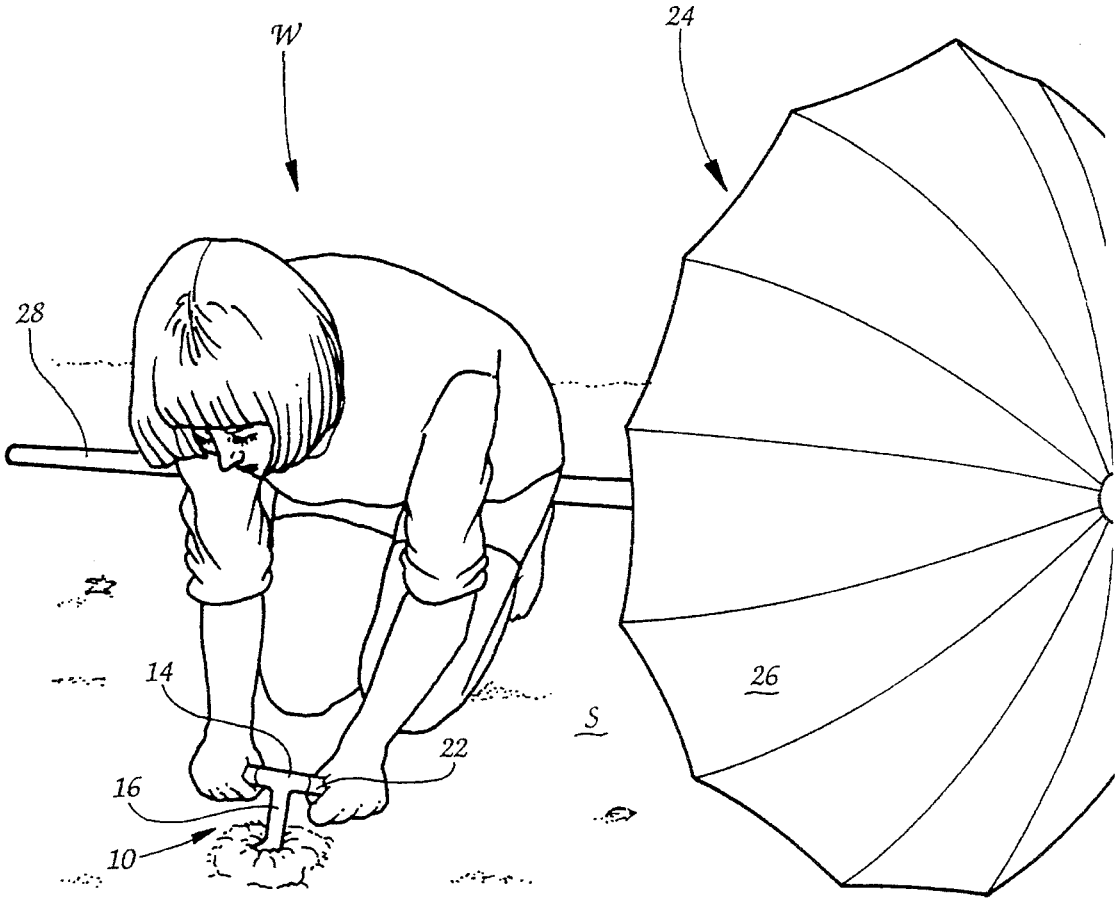
FIG. 1 is an environmental view of a beachgoer preparing a hole in the sand for her beach umbrella, using the preferred embodiment of the present invention.
Figure 2:
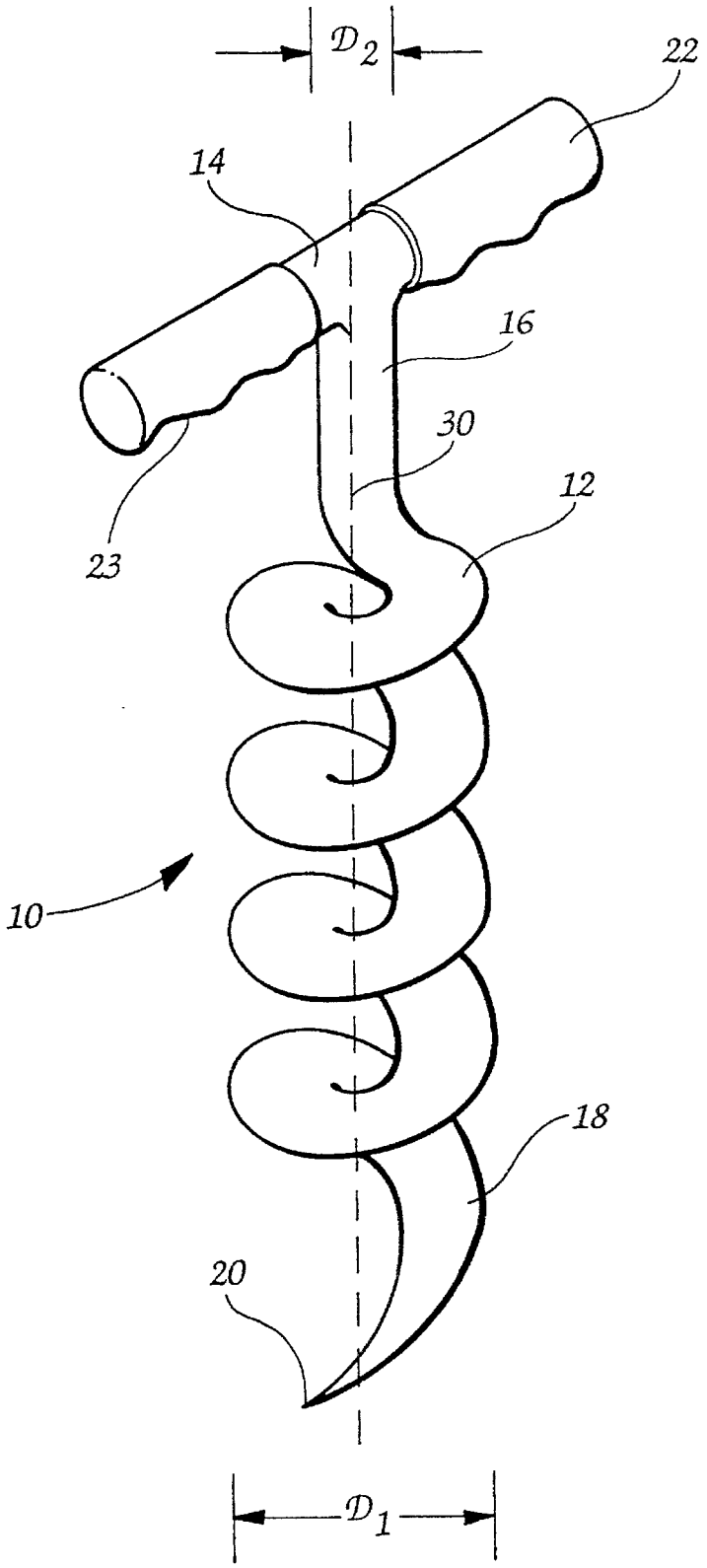
FIG. 2 is a perspective view of a device for facilitating the placement of a beach umbrella in the sand according to the preferred embodiment of the present invention.

Turning now to the drawings and more particularly to FIG. 1, a woman W is shown preparing the sand S for the insertion of a beach umbrella 24 using the present invention 10. The present invention 10, according to the preferred embodiment thereof, is illustrated in FIG. 2 and generally comprises a shaft 12 formed as a helix and extending from a first end portion 16 to a second end portion 18 terminating in a point 20 which is configured for the initial insertion of the shaft 12 in the sand. A handle 14 is integrally formed with the shaft 12 and is disposed at the outermost extent of the first end portion 16 to extend outwardly therefrom in a generally perpendicular relationship. The handle is configured for gripping by the hands of a user and, to that end, includes hand grips 22 which are formed with hand conforming portions 23. The hand grips 22 may be formed of rubber in the manner of a bicycle hand grip or plastic foam to provide a padded, comfortable gripping surface. It will be appreciated by those skilled in the art that the handle need not be integrally formed with the shaft to function properly, and that the invention is of a broader scope and utility. The handle may be detachable from the shaft and still provide the necessary mechanical advantage to form a hole in the sand.

The helical shaft 12 is curved from the end portion 16 downwardly through a symmetrical curvature about an axis of rotation 30 to the second end portion 18 and finally the point 20. The effective shaft length is configured to allow the device to form a hole in the sand of sufficient depth for supporting a beach umbrella in an upright disposition.

The shaft is formed of a predetermined diameter $d_2$ and through the helical curvature defines a major diameter $d_1$ which extends across the outermost extent of the helical curvature of the shaft 12. The shaft diameter $d_1$ should be approximately one quarter the value of the major diameter $d_2$ for sufficient sand displacement and compaction, but the diametrical ratio is not absolute.

Preferably, the device 10 including the shaft 12 and the handle 14 is formed of a lightweight material such as thermoplastic material but, for sufficient strength when boring sand, it is preferred that the shaft 12 and handle 14 be formed of Kevlar®. Kevlar® is a registered trademark of Du Pont de Nemours & Co. of Wilmington, Del.

Figure 3:
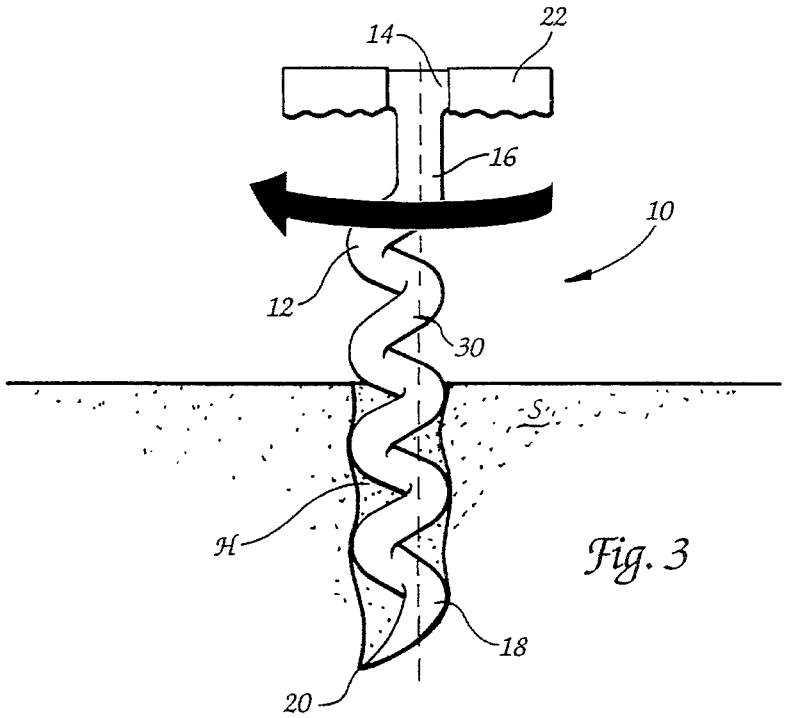
FIG. 3 is a side elevational view of the device of the present invention during the first stage of forming a hole in the sand.

In operation, and with reference to FIG. 3, the point 20 of the shaft 12 is directly downwardly into the sand S and the handle is gripped by a user in a manner illustrated in FIG. 1. Referring back to FIG. 3, the shaft 12 is rotated about its axis of rotation 30, as shown by an arrow in FIG. 3, which drives the helical shaft into the sand S forming a hole H.

Figure 4:
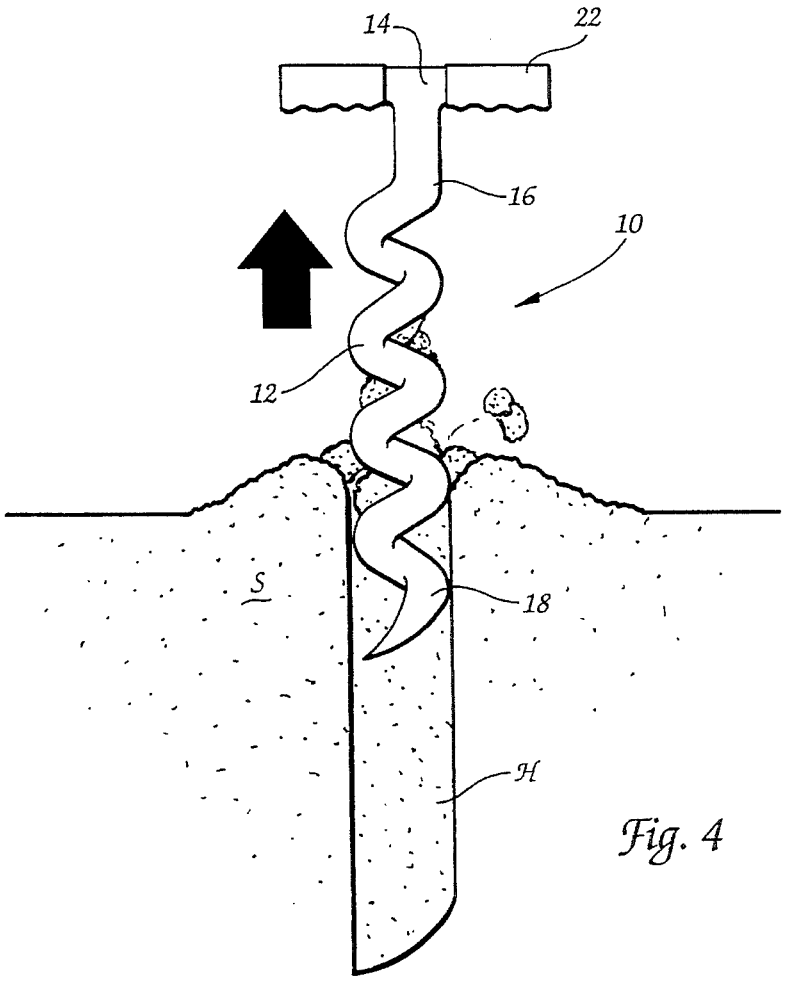
FIG. 4 is a side elevational view of the device illustrated in FIG. 2 during the second stage of forming a hole in the sand.

Once the shaft 12 is driven to a predetermined depth corresponding to the depth requirement of the beach umbrella, it is manually withdrawn from the sand S as shown by an arrow in FIG. 4. Since the shaft diameter $d_1$ is at least a quarter the value of the major diameter, very little sand packs within the coils of the helix and most of the sand is displaced away from the hole H which further compacts the sand adding to its ability to hold the beach umbrella upright. However, upon withdrawal, some sand will emerge from the opening and form a mound which also helps maintain the beach umbrella in an upright disposition. Therefore, withdrawal of the device 10 from the sand S leaves a hole H which conforms in diameter to the beach umbrella and leaves the sand adjacent the hole in a denser condition than was the case prior to boring the hole.

Figure 5:
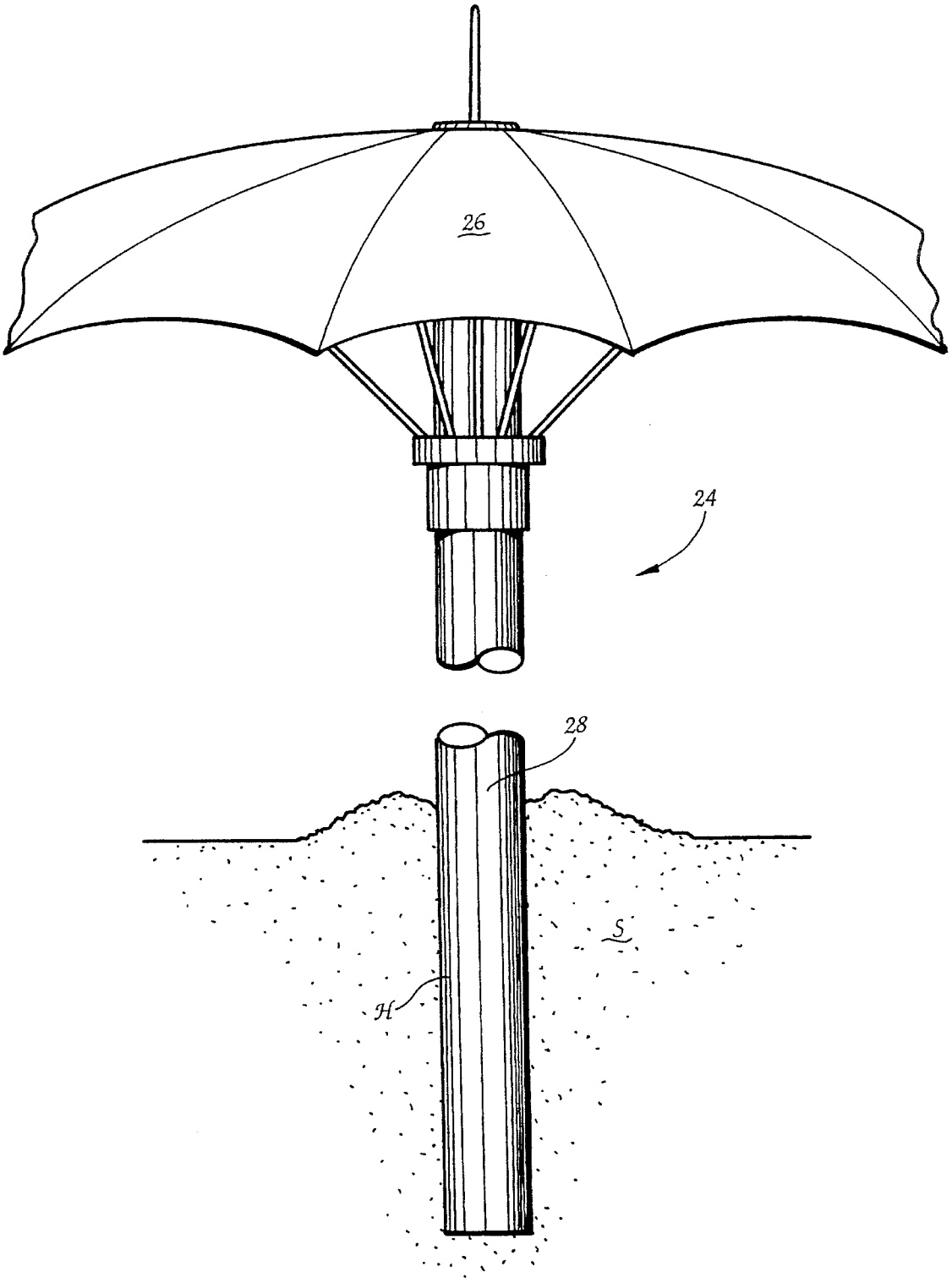
FIG. 5 is a side elevational view of a beach umbrella with its support shaft disposed in a hole formed by the present invention.

The beach umbrella 24 may then be gripped by its support shaft 28 and the support shaft 28 inserted into the hole H formed in the sand S as seen in FIG. 5. The compaction of the sand as well as the mounding of the sand in combination with the depth of the hole H acts to retain the beach umbrella in an upright disposition.

By the above, the present invention provides a simple, easy to manufacture and use implement for boring a hole in the sand which facilitates the upright disposition of a beach umbrella. The present invention is lightweight, easy to transport, and inexpensive to manufacture and purchase. Therefore, the enjoyment of a day at the beach by a beachgoer is enhanced.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A device for facilitating the upright placement of a beach umbrella in sand, the beach umbrella including a retractable canopy and a support shaft, said device comprising:

a generally longitudinally extending shaft having a first end portion and a second end portion, said shaft being formed as a helix about an axis of rotation, said helix defining a major diameter bounded by the outermost extent of the helical curvature, said diameter remaining substantially constant throughout the length of the helix, said first and second end portions being formed with a diameter that is a predetermined amount smaller than the value of said major diameter, said first end portion being configured for insertion in sand; and handle means disposed at said second end portion for manually causing rotation of said helical shaft for driving said shaft into the sand to pack the sand outwardly of the helical shaft, and for the manual withdrawal of said shaft thereby forming a hole in the sand for insertion of the beach umbrella support shaft thereinto.

2. A device for facilitating the upright placement of a beach umbrella in sand according to claim 1 wherein said helical shaft is formed with a diameter that is at least a quarter the size of said major diameter.

3. A device for facilitating the upright placement of a beach umbrella in sand according to claim 1 wherein said major diameter generally conforms to the diameter of the beach umbrella support shaft.

4. A device for facilitating the upright placement of a beach umbrella in sand according to claim 1 wherein said handle means is formed as a rod mounted to said second end portion in a generally perpendicular relationship therewith with a portion of said rod extending outwardly away from said helical shaft.

5. A device for facilitating the upright placement of a beach umbrella in sand according to claim 4 wherein said handle means includes a hand grip.

6. A device for facilitating the upright placement of a beach umbrella in sand according to claim 1 wherein said shaft is formed in a mold from a thermoplastic material.

7. In combination, a beach umbrella having a canopy mounted to a support shaft and a device for facilitating the upright placement of said beach umbrella in sand comprising:

a generally longitudinally extending shaft having a first end portion and a second end portion, said shaft being formed as a helix about an axis of rotation, said helix defining a major diameter bounded by the outermost extent of the helical curvature, said diameter remaining substantially constant throughout the length of the helix, said first and second end portions being formed with a diameter that is a predetermined amount smaller than the value of said major diameter, said first end portion being configured for insertion in sand; and handle means disposed at said second end portion for manually causing rotation of said helical shaft for driving said shaft into the sand to pack the sand outwardly of the helical shaft, and for the manual withdrawal of said shaft thereby forming a hole in the sand for insertion of said beach umbrella support shaft thereinto.

8. A device for facilitating the upright placement of a beach umbrella in sand according to claim 7 wherein said helical shaft is formed with a diameter that is at least a quarter the size of said major diameter.

9. A device for facilitating the upright placement of a beach umbrella in sand according to claim 7 wherein said major diameter generally conforms to the diameter of said beach umbrella support shaft.

10. A device for facilitating the upright placement of a beach umbrella in sand according to claim 7 wherein said handle means is formed as a rod mounted to said second end portion in a generally perpendicular relationship therewith with a portion of said rod extending outwardly away from said helical shaft.

11. A device for facilitating the upright placement of a beach umbrella in sand according to claim 10 wherein said handle means includes a hand grip.

* * * * *